US007641191B2

(12) United States Patent
Inui

(10) Patent No.: US 7,641,191 B2
(45) Date of Patent: Jan. 5, 2010

(54) SHEET CONVEYING APPARATUS AND IMAGE FORMING APPARATUS

(75) Inventor: Fumiki Inui, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 189 days.

(21) Appl. No.: 11/856,965

(22) Filed: Sep. 18, 2007

(65) Prior Publication Data

US 2008/0258378 A1 Oct. 23, 2008

(30) Foreign Application Priority Data

Sep. 29, 2006 (JP) ..... 2006-266431

(51) Int. Cl.
*B65H 9/16* (2006.01)

(52) U.S. Cl. ..... 271/251; 271/249

(58) Field of Classification Search ..... 271/248, 271/249, 250, 251

See application file for complete search history.

(56) References Cited

U.S. PATENT DOCUMENTS 6,702,280 B2 * 3/2004 Blank et al. ..... 271/248
7,404,557 B2 * 7/2008 Tada et al. ..... 271/226
2004/0188929 A1 * 9/2004 Tada et al. ..... 271/248
2007/0222144 A1 9/2007 Inui et al. ..... 271/291

FOREIGN PATENT DOCUMENTS

JP 8-292612 11/1996
JP 2000-233850 8/2000

* cited by examiner

*Primary Examiner*—Kaitlin S Joerger
(74) *Attorney, Agent, or Firm*—Fitzpatrick, Cella, Harper & Scinto

(57) ABSTRACT

An oblique feeding roller and a reference guide are provided on a re-conveying path for conveying a sheet in which an image has been formed on one side by an image forming unit to the image forming unit again. The sheet is obliquely fed by the oblique feeding roller. A side edge of the sheet abuts to a reference surface provided for the reference guide along a sheet conveying direction, thereby correcting the oblique motion and a positional deviation of the sheet. The reference guide is moved to a position according to a length in a width direction of the sheet which is conveyed by a movement of a cam.

12 Claims, 11 Drawing Sheets

SHEET CONVEYING APPARATUS AND IMAGE FORMING APPARATUS

BACKGROUND OF THE INVENTION

1. Field of the Invention

The present invention relates to a sheet conveying apparatus and an image forming apparatus and, more particularly, to the invention of positioning in a direction which perpendicularly crosses a sheet conveying direction of a sheet which is conveyed to an image forming unit.

2. Description of the Related Art

Hitherto, among image forming apparatuses such as an electrophotographic printer and the like, there is an apparatus in which a sheet in which an image has been formed on one side is reversed and conveyed again to an image forming unit, thereby forming an image onto a back side of the sheet. Such an image forming apparatus has a sheet conveying apparatus for reversing the sheet in which the image has been formed on one side and conveying the sheet again to the image forming unit (hereinafter, such an apparatus is referred to as a sheet re-conveying apparatus).

In such a conventional sheet re-conveying apparatus, when the sheet is conveyed again to the image forming unit, there is a case where the sheet is obliquely moved during the conveyance or the position is deviated, so that when the image is formed onto the back side, the image is deviated from a predetermined position on the sheet. This is because in the case of forming the image onto the second side (back side), a conveying path which is used until the image is formed onto the sheet is longer than that for the first side and the motion of the sheet is influenced by an eccentricity of a conveying roller or a difference between pressing forces in the conveying path or by a resistance of a conveying surface of a conveying guide. Consequently, the sheet is slightly obliquely moved during the conveyance or the position of the sheet in the direction (hereinbelow, referred to as a width direction) which perpendicularly crosses the sheet conveying direction is deviated from a reference position.

To prevent such an oblique motion or a positional deviation of the sheet, for a period of time until the image is formed onto the second side after the image was formed onto the first side, it is necessary to adjust the sheet position so that the position of the image coincides with that of the sheet.

As such a sheet position adjusting method, for example, there is a construction in which a reference guide is arranged in one end portion (of the re-conveying path for conveying the sheet again to the image forming unit) in the direction (hereinbelow, referred to as a width direction) which perpendicularly crosses the conveying direction of the sheet. There is a technique for performing the positioning in the sheet width direction (hereinbelow, referred to as a lateral registration correction) by conveying the sheet while pressing a side edge of the sheet to the reference guide. Such a technique has been disclosed in Japanese Patent Application Laid-Open No. 2000-233850.

FIGS. 9A, 9B, and 9C are top views illustrating a construction of the re-conveying path of the conventional sheet conveying apparatus having a lateral registration correcting unit for making the lateral registration correction of the sheet by such a reference guide. An example of the conventional sheet conveying apparatus will be described with reference to FIGS. 9A to 9C.

A lateral registration correcting unit 23 includes: a reference guide 24 having a reference surface 24*a* arranged along the sheet conveying direction; an oblique feeding roller pair 11A having an oblique feeding roller 11 and an oblique feeding rolling member (not shown) which is come into pressure contact with the oblique feeding roller 11; and a lower conveying guide 27 for guiding the lower side of the sheet. A rotary axis of the oblique feeding roller is arranged in the direction which perpendicularly crosses the reference surface 24*a*. A rotary axis of the oblique feeding rolling member is arranged so as to have an inclination of about 5° to 15° from the direction which perpendicularly crosses the reference surface 24*a*. The oblique feeding rolling member has a drum shape. Owing to such a structure, the sheet is sandwiched between the oblique feeding roller 11 and the oblique feeding rolling member and conveyed toward the reference surface 24*a*. Since the reference surface 24*a* is scraped by a sheet edge portion at the time of the sheet passage, the reference surface 24*a* is reinforced by forming a plurality of reference pins 24*h* made of a metal.

Subsequently, the lateral registration correcting operation of the lateral registration correcting unit 23 having such a construction will be described.

As illustrated in FIG. 9A, a sheet S in which an image has been formed on one side is conveyed from conveying rollers 3*g* provided on the upstream of the lateral registration correcting unit 23 toward the lateral registration correcting unit 23. After the sheet S reached the oblique feeding roller pair 11A, the sheet S is sandwiched between the oblique feeding roller pair 11A and conveyed. The sheet is conveyed while it is drawn toward the reference surface 24*a* side by the oblique feeding roller pair 11A. Subsequently, when a rear edge of the sheet S escapes from the conveying rollers 3*g*, the sheet S receives the resistance of the lower conveying guide 27 and rotates so that the sheet rear edge approaches the side of the reference surface 24*a* as illustrated in FIG. 9B. By the rotation, the sheet S is come into contact with the reference pins 24*h* and rotates by its reaction force so that a sheet front edge approaches the side of the reference surface 24*a*.

Thus, as illustrated in FIG. 9C, the sheet S is aligned to a position along the reference surface 24*a*, the oblique motion of the sheet is corrected, and further, a position in the width direction of the sheet is positioned to a reference position. After the lateral registration correction was made to the sheet S by the lateral registration correcting unit 23 as mentioned above, the sheet S is conveyed again to the image forming unit (not shown) through intermediate rollers 3*d*.

As mentioned above, in the lateral registration correcting unit 23, the sheet S is rotated by the oblique feeding roller pair 11A and the resistance of the lower conveying guide 27, and thereafter, the sheet S is rotated along the reference surface 24*a* while using the reference pins 24*h* as pivot points.

According to such a lateral registration correcting method, a conveyance distance until the sheet is aligned along the reference surface 24*a* after the rear edge of the sheet escaped from the conveying rollers 3*g* is short and an efficiency of the positioning (the oblique motion correction) is high. Therefore, even when the sheet is conveyed again, the positional deviation of the sheet can be certainly corrected and the sheet can be conveyed.

Among the image forming apparatuses each having such a sheet re-conveying apparatus, there is an apparatus which forms images onto two types of sheets of different sizes such as sheet of a letter size and sheet of an A4 size.

In such a case, for example, if the reference surface 24*a* of the reference guide 24 of the re-conveying path is set to the lateral registration correcting position for the sheet of the letter size and it is intended to make the lateral registration correction to the sheet of the A4 size by the same reference surface 24*a* as that of the sheet of the letter size, the following problem occurs.

When the lateral registration correction of the sheet of the A4 size is made, an amount in the width direction of the sheet which is necessary for making the sheet of the A4 size come into contact with the reference surface 24*a* is equal to 3 mm [=(a width of sheet of the letter size)−(a width of sheet of the A4 size)]. Further, when a deviation amount of the sheet during the conveyance until the sheet reaches the re-conveying path is assumed, the apparatus has to be set so that the sheet is moved to the reference surface 24*a* by up to about 5 mm. To draw the sheet to the reference surface 24*a* by about 5 mm as mentioned above, it is necessary to increase a conveying force of the oblique feeding roller pair 11A. For this purpose, a nip pressure of the oblique feeding roller pair 11A has to be set to be high. However, if the nip pressure of the oblique feeding roller pair 11A is increased as mentioned above, in the case where the sheet is a sheet having the letter size and a small rigidity, a drawing force to the reference surface 24*a* which is applied by the oblique feeding roller pair 11A becomes too strong. If the drawing force to the reference surface 24*a* is too strong, as illustrated in FIG. 10, the sheet S is deflected. If the sheet S is sandwiched between the intermediate rollers 3*d* on the downstream in the deflected state, the position in the width direction of the sheet is deviated. When the drawing force is too strong, the reference surface 24*a* made of a resin is scratched by the sheet edge portion. If the reference surface 24*a* is scratched, such a scratch becomes a conveyance resistance to the sheet edge portion and a sheet jam is caused by the scratch.

To avoid such a problem, hitherto, there is such an apparatus that the switching of the position in the width direction of the reference guide 24 is performed by using a driving force which is applied by a motor or the like. Such a technique has been disclosed in Japanese Patent Application Laid-Open No. H08-292612.

FIG. 11 is a plan view for describing a position adjusting mechanism of the reference guide 24 in such a conventional sheet re-conveying apparatus. In FIG. 11, a block driving plate 28 is fixed to the reference guide 24 and has a rack portion (not shown). A pinion gear 29 is in engagement with the rack portion (not shown) of the block driving plate 28.

A transfer gear 30 is driven by a driving motor (not shown). A rotating force of the driving motor is transferred to the transfer gear 30 and the pinion gear 29. The rack portion (not shown) is moved by the pinion gear 29, thereby moving the reference guide 24 in the width direction through the block driving plate 28.

When the lateral registration correction of the sheet is made, the position of the reference surface 24*a* is adjusted through the rack and pinion gear according to a rotation amount of the driving motor. By switching the position in the width direction of the reference guide 24 by using the motor as a driving source as mentioned above, the lateral registration correction of the sheets of various sizes can be made.

However, in the conventional sheet re-conveying apparatus having the construction in which the reference guide 24 is moved in the width direction by the rack and pinion gear, the reference guide 24 rattles in the width direction by a backlash of the gear, the position is not settled, and a deviation in the width direction of the reference surface 24*a* of an amount corresponding to the backlash occurs. There is, consequently, such a problem that print precision in the width direction of the sheet deteriorates.

SUMMARY OF THE INVENTION

The invention is, therefore, made in consideration of such a situation and it is an object of the invention to provide a sheet conveying apparatus and an image forming apparatus in which the positioning in the width direction of the sheet can be performed at high precision.

According to the invention, there is provided a sheet conveying apparatus for conveying a sheet by a sheet conveying path, comprising: a reference guide which is provided on the sheet conveying path along a sheet conveying direction; an oblique feeding unit which can obliquely convey the sheet and which abuts a side edge of the sheet to the reference guide; a moving mechanism which moves the reference guide in a direction which crosses the sheet conveying direction, wherein the moving mechanism has a cam and a driving source which moves the cam and the reference guide is moved in the direction which crosses the sheet conveying direction by a cam surface of the cam which is moved by the driving source.

Further features of the present invention will become apparent from the following description of exemplary embodiments with reference to the attached drawings.

DESCRIPTION OF THE EMBODIMENTS

An exemplary embodiment for embodying the invention will now be described in detail hereinbelow with reference to the drawings.

Figure 1:
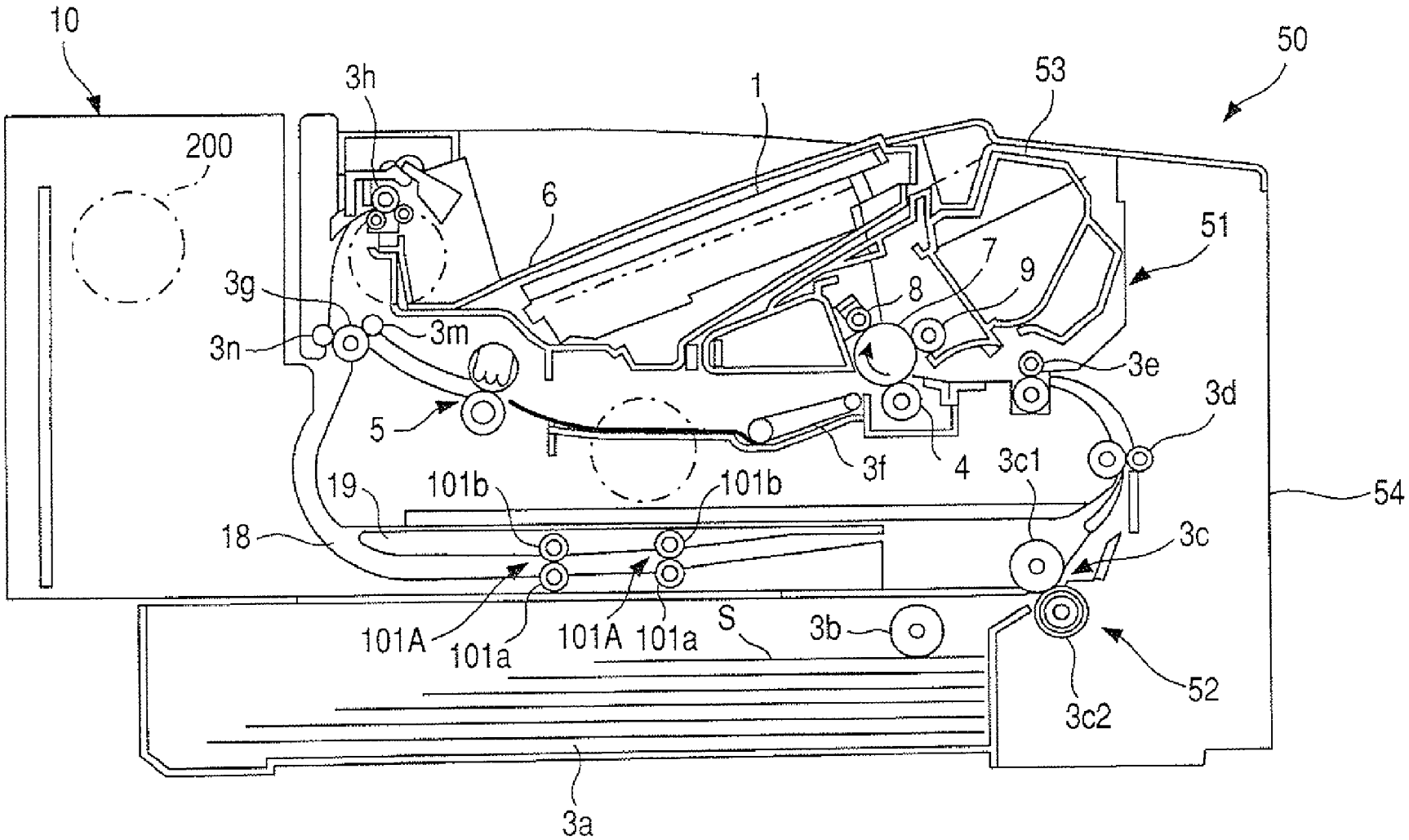
FIG. 1 is a diagram illustrating a schematic construction of a laser beam printer (LBP) as an example of an image forming apparatus having a sheet conveying apparatus according to an embodiment of the invention.

FIG. 1 is a diagram illustrating a schematic construction of a laser beam printer (LBP) as an example of an image forming apparatus having a sheet conveying apparatus according to an embodiment of the invention.

In FIG. 1, a laser beam printer (LBP) 50 forms an image by the electrophotographic system. The LBP 50 has: an image forming unit 51 for forming the image; a sheet feeding unit 52 for separating and feeding the sheets S to the image forming unit 51 one by one; and the like. As an option, the LBP 50 has a duplex unit 10 serving as a sheet re-conveying apparatus so that the images can be formed on both sides of the sheet S. That is, the duplex unit 10 feeds the sheet S again to the image forming unit 51 in order to form the image onto the back side after the image was formed on one side. The image forming unit 51 has a process cartridge 53, a transfer roller 4, a fixing unit 5, and the like. The process cartridge 53 integratedly has: a photosensitive drum 7; a charging roller 8 for uniformly charging the surface of the photosensitive drum; a developing unit 9 for developing an electrostatic latent image formed on the photosensitive drum; and the like. The process cartridge 53 is detachable for a laser beam printer main body (hereinbelow, referred to as an apparatus main body) 54.

The sheet feeding unit 52 has: a sheet feeding cassette 3*a* in which the sheets S are stacked; a pickup roller 3*b*; and a separating roller pair 3*c* including a feeding roller 3*c*1 and a retard roller 3*c*2. The sheets fed out by the pickup roller 3*b* are separated one by one between the feeding roller 3*c*1 and the retard roller 3*c*2.

The duplex unit 10 has: a re-conveying path 18; and a lateral registration correcting unit, which will be described hereinafter, having an oblique feeding roller pair 101A and the like. Further, a laser scanner unit 1 and a discharge tray 6 are illustrated in FIG. 1.

Subsequently, the image forming operation of the LBP 50 constructed as mentioned above will be described.

Figure 8:
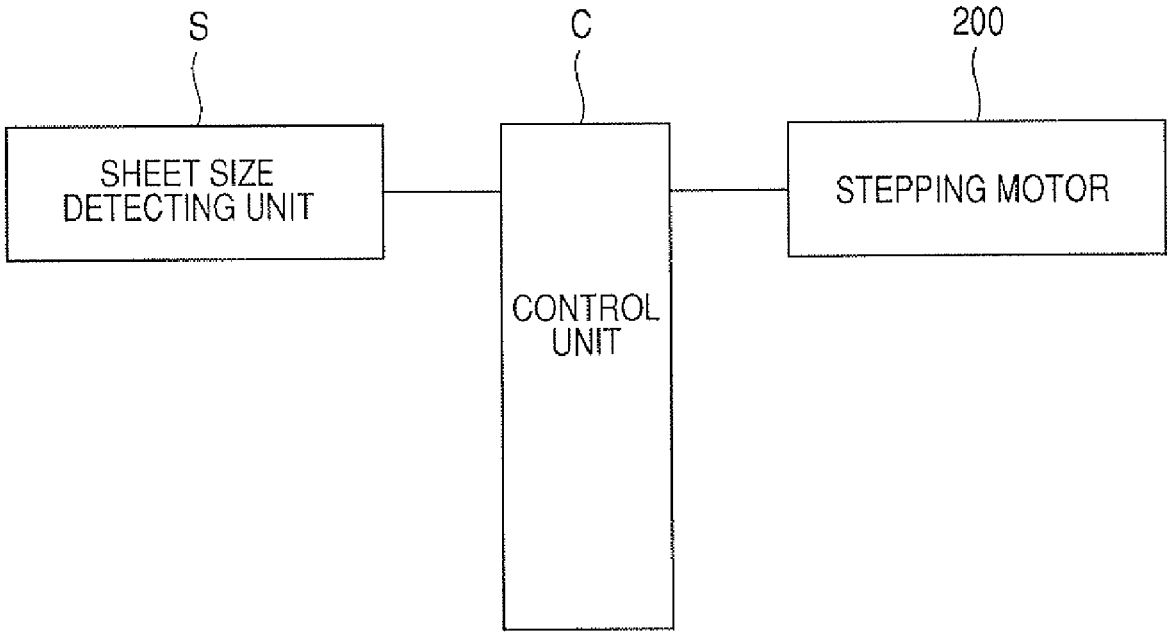
FIG. 8 is a control block diagram for controlling the duplex unit.
Figure 9A:
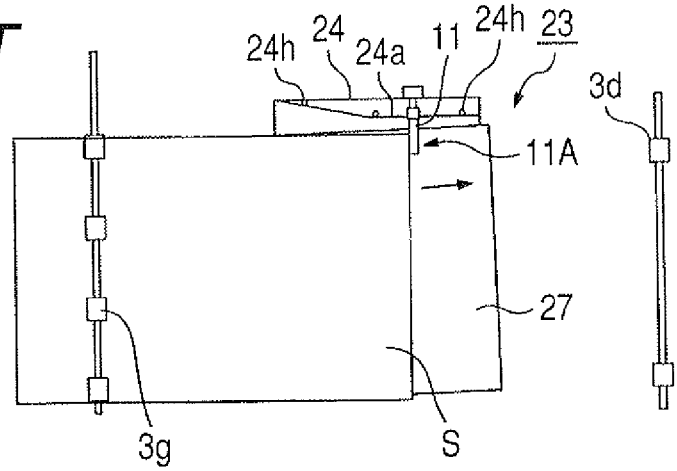
FIG. 9A PRIOR ART
FIGS. 9A, 9B, and 9C are diagrams illustrating a construction of a re-conveying path and the lateral registration correction of a conventional sheet conveying apparatus.
Figure 9B:
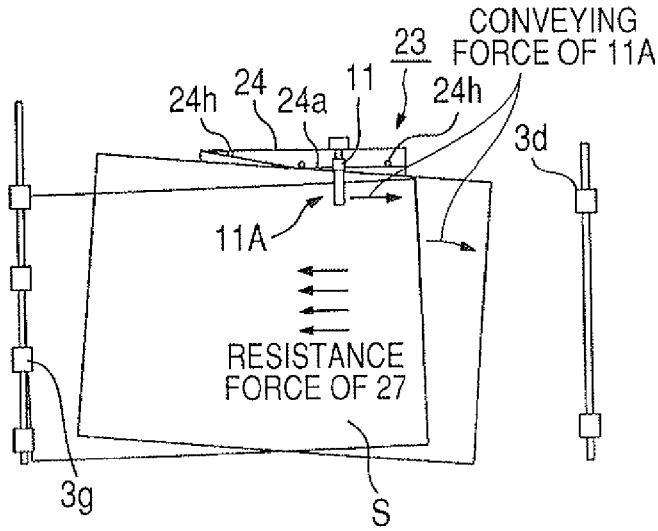
FIG. 9B PRIOR ART
Figure 9C:
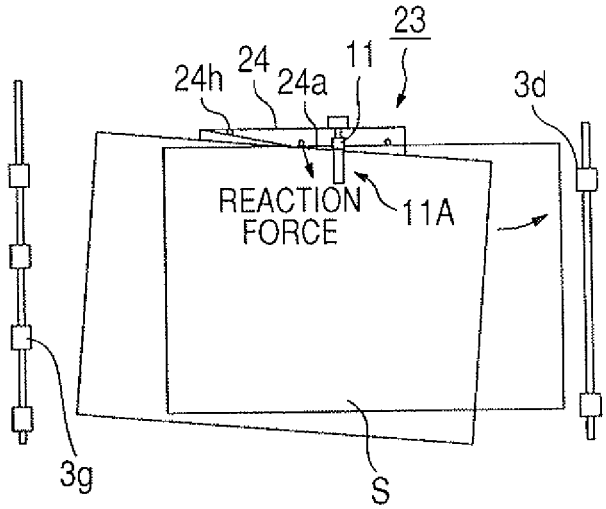
FIG. 9C PRIOR ART

Image information is sent from a personal computer (PC) or the like to a control unit C (illustrated in FIG. 8). After the image information was image-forming processed in the control unit C, a print signal is generated from the control unit C. Thus, first, the photosensitive drum 7 is rotated in the direction shown by an arrow and the drum surface is uniformly charged to a predetermined polarity and a predetermined electric potential by the charging roller 8. A laser beam is irradiated from the laser scanner 1 based on the image information to the photosensitive drum 7 whose surface has been charged in this manner, so that the electrostatic latent image is formed on the photosensitive drum 7. This electrostatic latent image is developed by the developing unit 9 and visualized as a toner image.

In parallel with such a toner image forming operation, the sheets S stacked and enclosed in the sheet feeding cassette 3*a* are fed out by the pickup roller 3*b* and, thereafter, separated and conveyed by the separating roller pair 3*c* one by one. After that, the sheet S is conveyed by a conveying roller pair 3*e* to a transfer unit including the photosensitive drum 7 and the transfer roller 4.

In this instance, a front edge of the sheet S is detected by a registration sensor (not shown) provided on the upstream of the transfer unit. Based on a detection signal of the registration sensor, the control unit C synchronizes a front edge position of the sheet S with light emission timing of the laser scanner 1. Thus, the toner image formed on the photosensitive drum can be transferred to a predetermined position on the sheet S.

Subsequently, the sheet S on which the toner image has been transferred is conveyed to the fixing unit 5 along a conveying belt 3*f*. When the sheet passes through the fixing unit 5, it is heated and pressed, so that the toner image is semipermanently fixed.

In the case of executing the simplex printing (one-side printing), the sheet S which has passed through the fixing unit 5 is sent to a nip between the conveying roller 3*g* and a first rolling member 3*m* and, thereafter, ejected to the discharge tray 6 by the forward rotation of the conveying roller 3*g* and the forward rotation of a discharge roller 3*h* which can forwardly and reversely rotate.

In the case of executing the duplex printing (two-side printing), the discharge roller 3*h* conveys the sheet S toward the discharge tray 6 by the forward rotation. Subsequently, after a rear edge of the sheet escaped from the conveying roller 3*g*, the discharge roller 3*h* is reversely rotated. When the rear edge of the sheet S escapes from the conveying roller 3*g*, the rear edge is moved toward a second rolling member 3*n* side due to its rigidity. When the discharge roller 3*h* is reversely rotated in this state, the rear edge of the sheet S enters a nip between the conveying roller 3*g* and the second rolling member 3*n* and is sandwiched between the conveying roller 3*g* and the second rolling member 3*n*.

The sheet S sandwiched between the conveying roller 3*g* and the second rolling member 3*n* as mentioned above is conveyed into the duplex unit 10. In the duplex unit 10, the sheet S passes through the re-conveying path 18 and the oblique motion is corrected by the oblique feeding roller pairs 101A provided at two positions. After that, the sheet S passes through the intermediate rollers 3*d* and is sent to the image forming unit 51 again. The image of the second time is formed by the image forming unit 51 and, thereafter, the sheet is ejected onto the discharge tray 6 by the discharge roller 3*h*.

Figure 2:
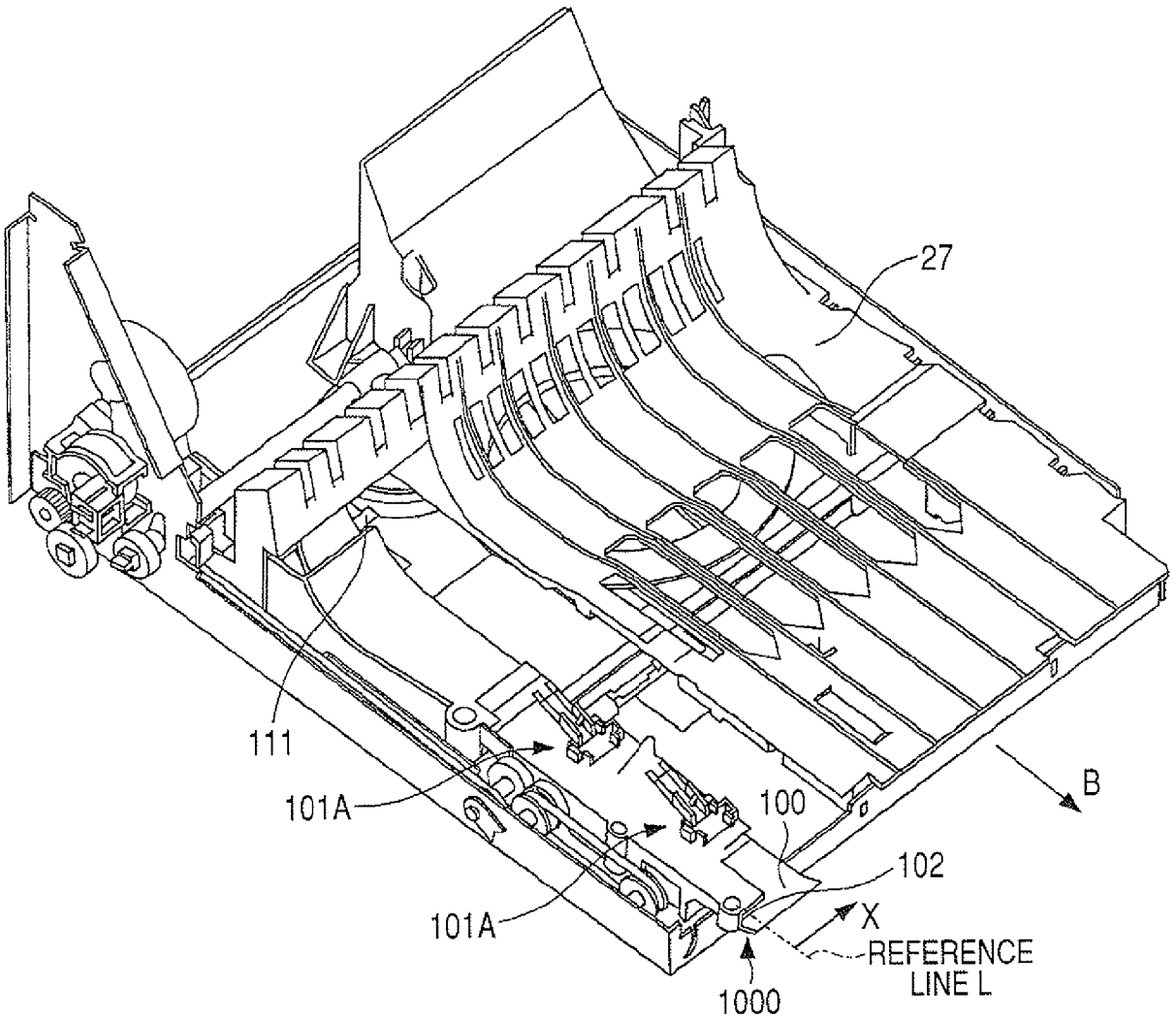
FIG. 2 is a perspective view illustrating an upper portion of a duplex unit as a sheet conveying apparatus.

As illustrated in FIG. 2, the duplex unit 10 serving as a sheet re-conveying apparatus has a lateral registration correcting unit 1000 serving as an oblique motion correcting unit having the oblique feeding roller pairs 101A and a reference guide 100 which holds the oblique feeding roller pairs 101A and the like. In FIG. 2, the lower conveying guide 27 is arranged in parallel with the reference guide 100 and constructs the lower surface (bottom surface) of the re-conveying path. The sheet which passes through the re-conveying path 18 is conveyed again to the image forming unit through the lower conveying guide 27 and the reference guide 100.

A reference surface 102 is provided along the sheet conveying direction for one end portion (of the reference guide 100) in the width direction which perpendicularly crosses the sheet conveying direction shown by an arrow B. When the sheet passes through the re-conveying path 18, the sheet is pressed onto the reference surface 102 by the oblique feeding roller pairs 101A and the lateral registration correction in the width direction of the sheet is made.

Figure 3:
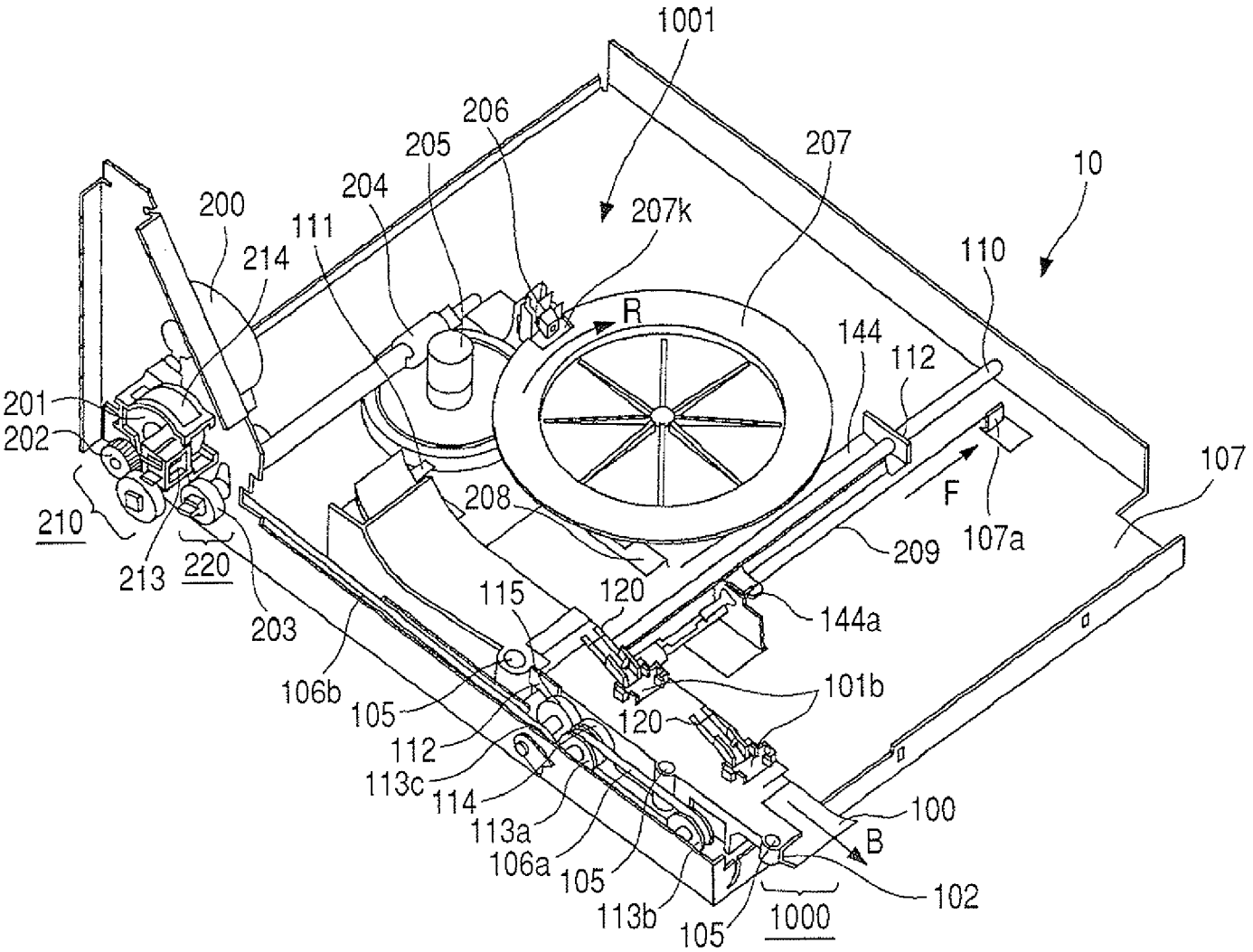
FIG. 3 is a perspective view for describing a construction of the duplex unit.

The reference surface 102 is extended in the sheet conveying direction and the positioning in the width direction of the sheet is performed. Since the reference surface 102 is scraped by the pressed sheet, as illustrated in FIG. 3, a plurality of reference pins 105 made of a metal such as SUS or the like are inserted into the reference surface 102 with a pressure, thereby reinforcing the reference surface 102. The reference guide 100 has a U-shape, is made of a resin such as PC+ABS, PPE, or the like, and has conveying guide surfaces in the width direction of the sheet and the upper and lower surfaces of the sheet.

As illustrated in FIG. 1, the oblique feeding roller pair 101A has: an oblique feeding roller 101*a* which is supported by a rotary axis arranged in the direction which perpendicularly crosses the sheet conveying direction; and a driven rolling member 101*b* which is supported by a rotary axis arranged in the oblique feeding roller 101*a* with a predetermined oblique feeding angle and is obliquely in pressure-contact with the oblique feeding roller 101*a*. As illustrated in FIG. 3, the driven rolling member 101*b* is always in contact with the oblique feeding roller 101*a* with a predetermined pressure by a torsion spring 120.

The sheet is conveyed by the conveying rollers 3*g* (refer to FIG. 1) provided on the upstream of the lateral registration correcting unit 1000 and the oblique feeding roller pair 101A held by the reference guide 100 draws the conveyed sheet toward the reference surface 102. After that, the sheet is conveyed along the reference surface 102. Thus, the position in the width direction of the sheet S is matched with a conveyance reference line connected by the reference pins 105. In this state, the sheet is conveyed to the intermediate rollers 3*d* provided on the downstream of the lateral registration correcting unit 1000.

Further, in FIG. 3, a stepping motor 200 as a driving source and timing belts 106*a* and 106*b* are illustrated. A driving force of the stepping motor 200 is transferred to the oblique feeding roller pair 101A through the timing belts 106*a* and 106*b* and pulleys 113*a* to 113*c*. The stepping motor 200 can forwardly and reversely rotate and rotates a cam 207, which will be described hereinafter.

The lateral registration correction is made by matching the position in the width direction while pressing the obliquely-moved sheet S onto the reference surface 102 of the reference guide 100. In the lateral registration correction, an optimum distance adapted to draw the sheet S toward the reference surface 102 is equal to about 2 mm in the X direction from a conveyance reference line L illustrated in FIG. 2.

However, depending on the sheet size, there is a case where the sheet has to be drawn toward the reference surface 102 from the position where, for example, it is away from the conveyance reference line L in the X direction by 2 mm or more. In such a case, it is necessary to increase an oblique motion amount. For this purpose, as mentioned above, a nip pressure of the oblique feeding roller pair 101A has to be set to be high.

Figure 10:
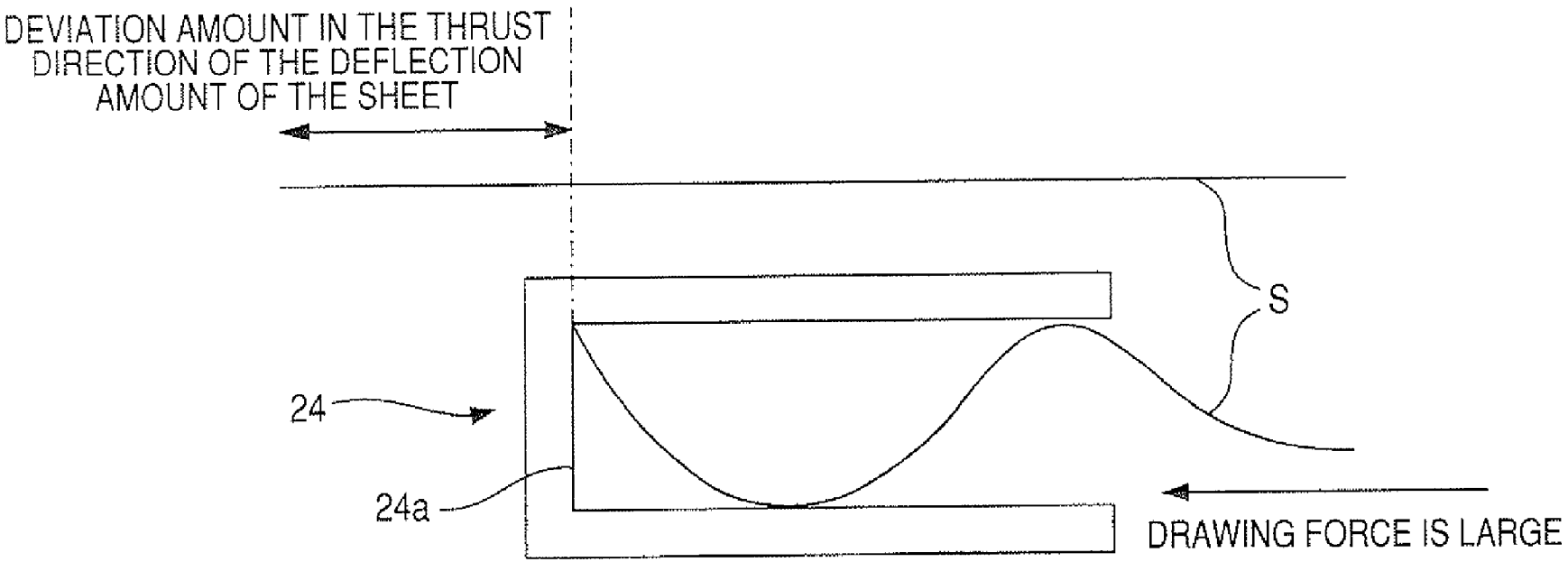
FIG. 10 PRIOR ART
FIG. 10 is a diagram illustrating a state where the sheet has been drawn toward a reference surface by a large drawing force in the conventional sheet conveying apparatus.
Figure 11:
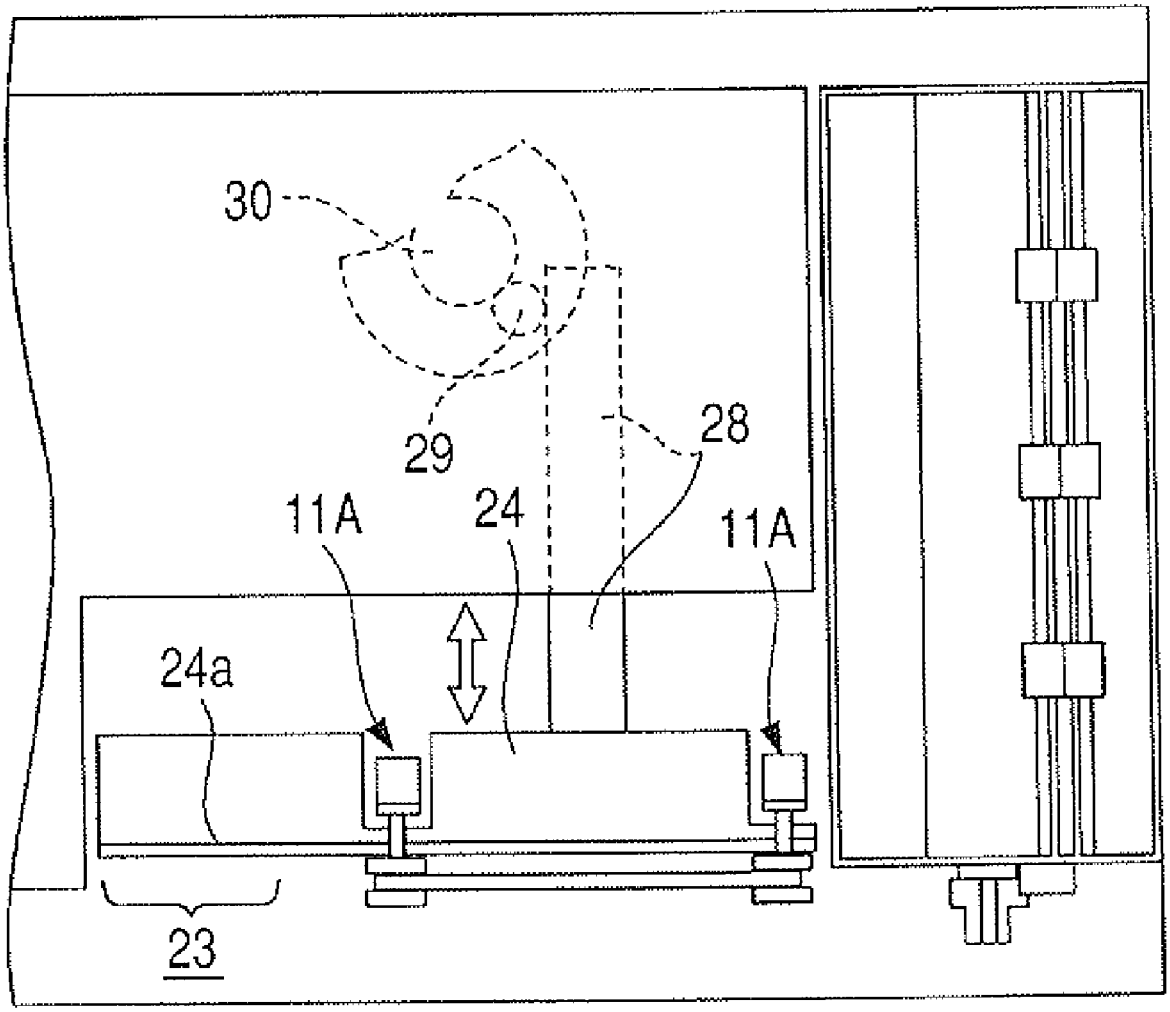
FIG. 11 PRIOR ART
FIG. 11 is a plan view for describing a position adjusting mechanism of a reference guide in the conventional sheet conveying apparatus.

However, when the nip pressure is set to a high value as mentioned above, since the drawing force to the reference surface 102 is too strong in the case of a thin sheet as illustrated in FIG. 10, the sheet S is deflected, the position in the width direction of the sheet to the reference surface 102 is deviated, and the sheet is conveyed again. Further, if the drawing force in the width direction is too large, the reference surface 102 is scratched by the sheet edge portion, and the sheet jam is caused due to the scratch.

In the embodiment, therefore, (the reference surface 102 of) the reference guide 100 can be moved to the position according to the length in the width direction of the sheet so that the lateral registration correction of the sheets of various sizes can be made. Specifically speaking, the lateral registration correcting unit 1000 is moved in the width direction according to the sheet size (length in the width direction of the sheet) so that the movement distance adapted to draw the sheet S toward the reference surface 102 is set to about 2 mm.

Figure 4:
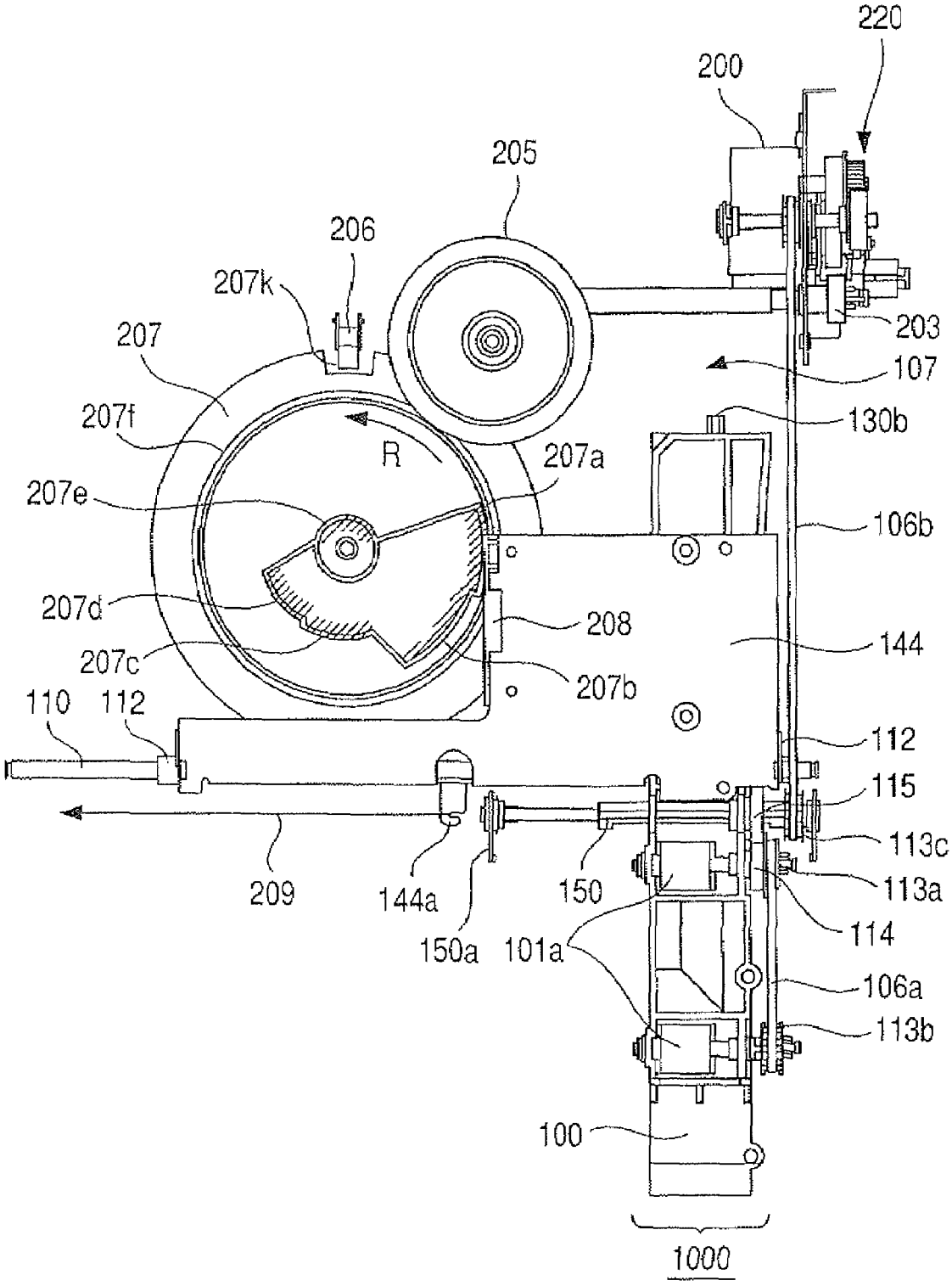
FIG. 4 is a schematic bottom view for describing the construction of the duplex unit.

Subsequently, a moving mechanism 1001 for moving the lateral registration correcting unit 1000 in the width direction as mentioned above will be described with reference to FIGS. 3 and 4. FIG. 3 is a perspective view illustrating a state where the lower conveying guide 27 has been removed. FIG. 4 is a diagram seen from the bottom side. The sheet is conveyed in the direction shown by the arrow B in FIG. 3 and is conveyed downwardly from the top in FIG. 4.

In FIGS. 3 and 4, a bottom plate 107 is a structure of the duplex unit 10. A main axis 110 made of SUS, SUM, or the like is provided in the width direction for the bottom plate 107. A plate 144 is attached to a bottom surface of the lateral registration correcting unit 1000. The plate 144 has a bearing 112 for axially supporting the main axis 110 so that the lateral registration correcting unit 1000 can be moved in the axial direction along the main axis 110.

Through the bearing 112 and the main axis 110 provided for the plate 144, the lateral registration correcting unit 1000 is attached to the bottom plate 107 so as to be movable in the width direction. Although the main axis 110 has been arranged in the direction which perpendicularly crosses the sheet conveying direction as a width direction of the sheet in the embodiment, the main axis 110 can be arranged in the direction which crosses the sheet conveying direction, thereby obliquely moving lateral registration correcting unit 1000.

The bearing 112 performs the positioning of the lateral registration correcting unit 1000 to the bottom plate 107 through the main axis 110. The bearings 112 are arranged at two locations with a span which is long in the width direction. Consequently, a variation of positional precision adapted to decide print precision of the lateral registration correcting unit 1000 due to precision of parts can be suppressed.

Figure 5:
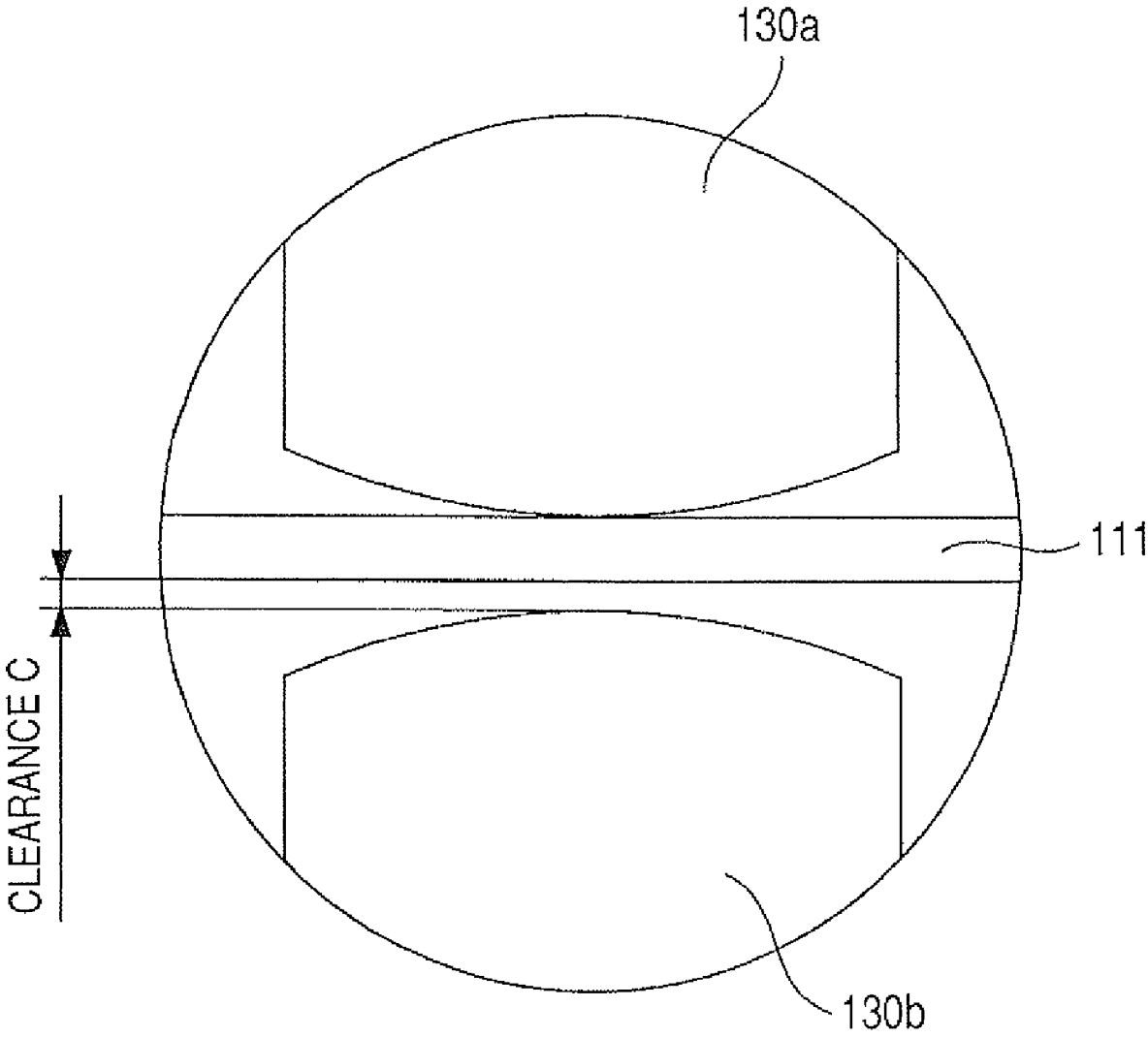
FIG. 5 is an enlarged diagram of a rail portion provided for the duplex unit.

As illustrated in FIG. 2, a rail portion 111 bent in a Z-character shape from the bottom plate 107 is provided for the upstream side in the conveying direction of the bottom plate 107 in parallel with the main axis 110. As illustrated in FIG. 5, rotation stopping members 130*a* and 130*b* which are come into engagement with the rail portion 111 and restrict the rotation around the main axis 110, as a fulcrum, of the reference guide 100 (lateral registration correcting unit 1000) are provided.

A contact surface of each of the rotation stopping members 130*a* and 130*b* with the rail portion 111 has an arc shape. A clearance C of about 0.2 mm is provided between the rail portion 111 and the rotation stopping member 130*b*. By providing such a clearance C, even if a deviation of parallelism between the main axis 110 and the rail portion 111, a warp of the plate 144, or a deviation of tolerance occurs, the rotation stopping members 130*a* and 130*b* are come into engagement with the rail portion 111 in a point contact manner without scraping.

Therefore, a slide resistance which is caused when the lateral registration correcting unit 1000 is moved in the width direction can be reduced. Consequently, the lateral registration correcting unit 1000 can be smoothly moved in the width direction and the positional precision to the bottom plate 107 can be also assured.

In FIGS. 3 and 4, the cam 207 is provided for the side of the reference guide 100 and rotates only in one direction shown by an arrow R. The cam 207 has: a gear 207*f* which is come into engagement with an idler gear 205; and cam surfaces 207*a* to 207*e* arranged along the rotating direction. As will be described hereinafter, those five cam surfaces 207*a* to 207*e* move and hold the lateral registration correcting unit 1000 so as to restrict the unit 1000 to the positions where the lateral registration correction of the sheets of the letter size, A4 size, EXE size, B5 size, and A5 size can be made, respectively.

The cam 207 is driven by through a gear train 220 for driving the lateral registration correcting unit, a worm gear 204, and the idler gear 205.

An initial sensor 206 detects a rotation initial position of the cam 207 by the stepping motor 200 detecting a notch portion 207*k* formed in an outer peripheral portion of the cam 207. In the embodiment, when the cam 207 is located at the initial position, the conveyance reference line L of the lateral registration correcting unit 1000 is located at a position where the lateral registration correction of the sheet of the letter size can be made.

A helical tension spring 209 is made of an urging member. One end of the helical tension spring 209 is retained to a hooking portion 144*a* provided for the plate 144 mentioned above and the other end is retained to a retaining portion 107*a* vertically formed on the bottom plate 107, respectively. The plate 144 is urged in the direction shown by an arrow F as a width direction by the helical tension spring 209.

A pressure contact portion 208 for allowing the plate 144 to be come into pressure contact with the cam surfaces 207*a* to 207*e* of the cam 207 by the helical tension spring 209 is provided for the plate 144. The lateral registration correcting unit 1000 is in pressure contact with the cam surfaces 207*a* to 207*e* of the cam 207 through the pressure contact portion 208 by the helical tension spring 209.

As mentioned above, the moving mechanism 1001 is constructed by: the cam 207; the pressure contact portion 208; the helical tension spring 209; and the stepping motor 200 for rotating the cam 207 against an urging force of the helical tension spring 209. By constructing the moving mechanism 1001 as mentioned above, the plate 144 which is in pressure contact with the cam 207, that is, the lateral registration correcting unit 1000 can be moved from a letter position illustrated in FIG. 4 to an A5 position illustrated in FIG. 6 by the rotation of the cam 207.

In the lateral registration correcting unit 1000, a point of a force which is generated by the hooking portion 144*a* of the helical tension spring 209 and a cam pressing portion of the pressure contact portion 208 is arranged in the span between the bearings 112 in the width direction. Thus, the scrape of the lateral registration correcting unit 1000 for the main axis 110 which is caused by a moment of the urging force is suppressed. The lateral registration correcting unit 1000 can be smoothly moved in the width direction.

When the lateral registration correcting unit 1000 is moved, the oblique feeding roller pair 101A is also moved in the width direction. Even if the oblique feeding roller pair 101A is moved in the width direction as mentioned above, the driving force is transferred to the oblique feeding roller pair 101A.

Subsequently, the construction in which the driving force is transferred to the oblique feeding roller pair 101A which moves together with the lateral registration correcting unit 1000 as mentioned above will be described.

The stepping motor 200 is used to drive the oblique feeding roller pair 101A (oblique feeding roller 101*a*). First, the rotational driving force of the stepping motor 200 is transferred to the pulley 113*c* through a pendulum unit 230 and a gear train 210 illustrated in FIG. 7, which will be described hereinafter, and the timing belt 106*b* illustrated in FIG. 4.

A slide axis 150 is coaxially provided for the pulley 113*c*. The pulley 113*c* and the slide axis 150 are rotatably held to a bearing 150*a* provided for the bottom plate 107. A movable gear 115 is attached to the slide axis 150 so as to be slidable in the axial direction.

The movable gear 115 rotates the pulley 113*a* having a gear portion (not shown). When the movable gear 115 rotates, the pulley 113*a* rotates. In association with the rotation of the pulley 113*a*, the oblique feeding roller 101*a* integrated with the pulley 113*b* is driven. The rotation of the pulley 113*a* is transferred to the pulley 113*b* through the timing belt 106*a*. When the rotation is transferred to the pulley 113*b* in this manner, the oblique feeding roller 101*a* integrated with the pulley 113*b* is rotated.

In the embodiment, each of the slide axis 150 and a through hole (not shown) of the movable gear 115 into which the slide axis 150 is pierced is formed in a D cross sectional shape. Thus, the slide axis 150 can transfer the rotation of the slide axis 150 to the movable gear 115 without obstructing the slide of the movable gear 115 in the width direction.

Figure 6:
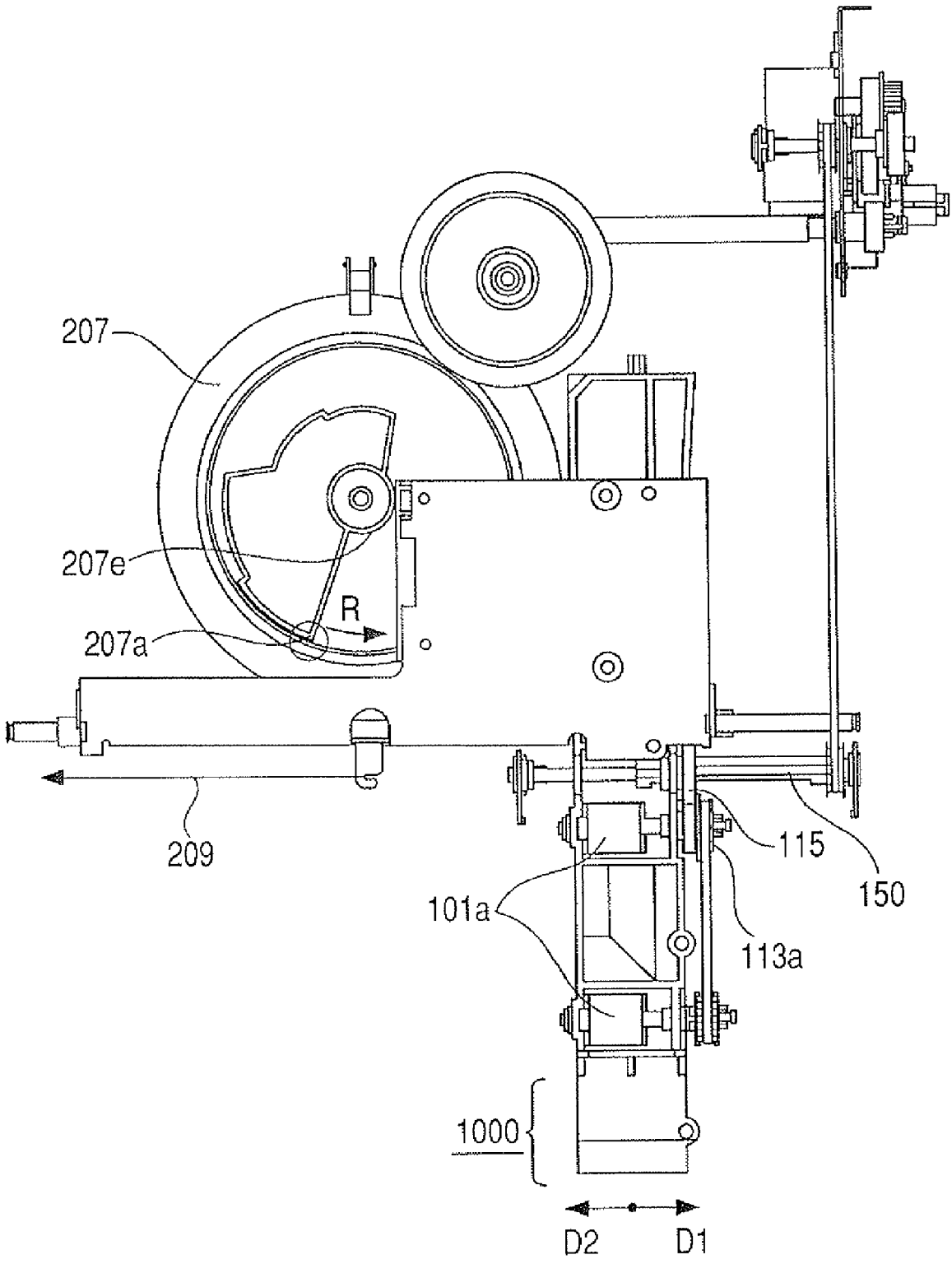
FIG. 6 is a bottom view illustrating a state where a lateral registration correcting unit has been moved.

When the lateral registration correcting unit 1000 is moved from the letter position illustrated in FIG. 4 to the A5 position illustrated in FIG. 6, a movable gear 114 is pressed by a flange (not shown) provided for the pulley 113*a* and moved. On the contrary, when the lateral registration correcting unit 1000 is moved in the direction from the A5 position to the letter position, the movable gear 114 is pressed by a side wall of the reference guide 100 and moved.

As mentioned above, even in the case where the lateral registration correcting unit 1000 has been moved to the lateral registration correcting position corresponding to the sheet because the movable gear 114 was moved along the slide axis 150, the driving force of the slide axis 150 can be transferred to the oblique feeding roller 101*a* through the movable gear 114.

Subsequently, the operation for moving the lateral registration correcting unit 1000 to the lateral registration correcting position corresponding to the sheet size will be described.

For example, when the lateral registration correcting unit 1000 is located at the letter position (initial position), the pressure contact portion 208 has been abutted to the cam surface 207*a* corresponding to the letter position of the cam 207 by the urging force of the helical tension spring 209 as illustrated in FIG. 4. Thus, the lateral registration correcting unit 1000 is positioned to the lateral registration correcting position corresponding to the sheet of the letter size.

For example, in order to move the lateral registration correcting unit 1000 to the A5 position illustrated in FIG. 6 in this state, the stepping motor 200 is rotated by a predetermined number of steps.

In the embodiment, as mentioned above, the oblique feeding roller pair 101A (oblique feeding roller 101*a*) is driven by one stepping motor 200 and the lateral registration correcting unit 1000 is moved by the moving mechanism 1001.

Figure 7:
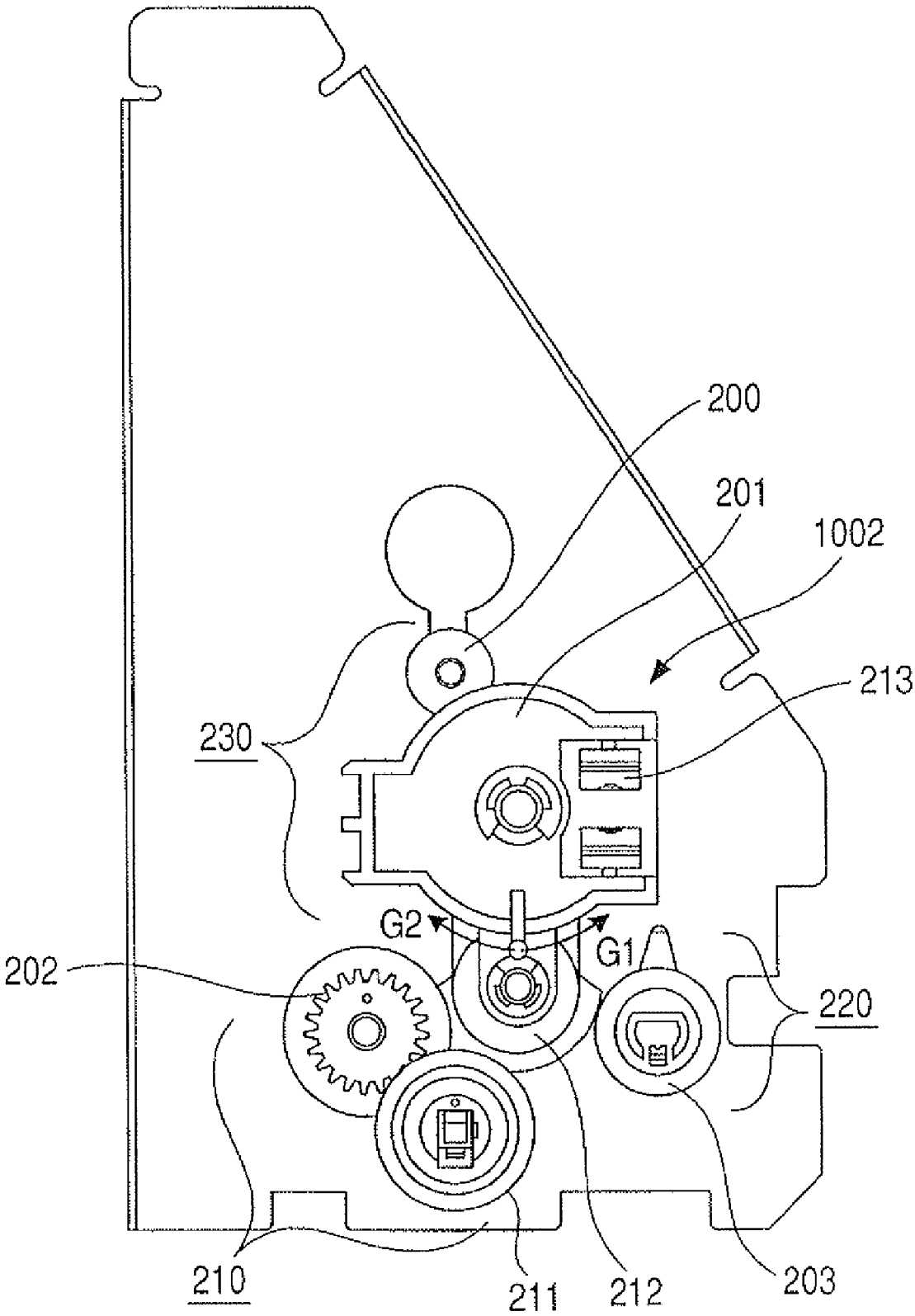
FIG. 7 is a diagram illustrating a construction of a switching unit for switching driving of a stepping motor provided for the duplex unit to one of an oblique feeding roller pair side and the lateral registration correcting unit side.

FIG. 7 is a diagram illustrating a construction of a switching unit 1002 for switching the driving force of the stepping motor 200 to one of the oblique feeding roller pair side and the lateral registration correcting unit side.

In FIG. 7, the pendulum unit 230 swings in the directions shown by arrows G1 and G2 according to the forward and reverse rotations of the stepping motor 200. The pendulum unit 230 has: a pendulum arm 201; a driving gear 214 (illustrated in FIG. 3) which is rotated in the directions of the arrows G1 and G2 by the stepping motor 200; and a moving gear 212 held to the pendulum arm 201. The pendulum unit 230 also has pressing members 213 each of which is urged toward the driving gear side by a compression spring (not shown).

When the driving gear 214 is rotated in the directions of G1 and G2 by the forward and reverse rotations of the stepping motor 200, the pendulum arm 201 swings in the G1 and G2 directions by the friction between the driving gear 214 and the pressing members 213.

For example, when the stepping motor 200 rotates counterclockwise, the pendulum unit 230 swings in the G2 direction. In association with it, the moving gear 212 held to the pendulum arm 201 is come into engagement with a gear 202. Thus, the rotation of the stepping motor 200 is transferred to the oblique feeding roller 101*a* through the gear 202 and a gear 211 which construct a gear train 210 and the timing belts 106*a* and 106*b*.

When the stepping motor 200 rotates clockwise, the pendulum unit 230 swings in the G1 direction. In association with it, the moving gear 212 held to the pendulum arm 201 is come into engagement with a gear 203. Thus, the rotation of the stepping motor 200 is transferred clockwise through the gear 203 and the idler gear 205 which construct the gear train 220.

When the rotation of the stepping motor 200 is transferred to the cam 207 as mentioned above, the cam 207 rotates in the direction of the arrow R as illustrated in FIG. 4. In association with it, the cam surface which is come into contact with the pressure contact portion 208 is changed according to a rotation amount of the cam 207 in order of the cam surface 207*a*→the cam surface 207*b*→the cam surface 207*c*→the cam surface 207*d*→the cam surface 207*e*. Thus, the lateral registration correcting unit 1000 is moved in the direction of an arrow D2 shown in FIG. 6, passes along a path of the letter position→the A4 position→the EXE position→the B5 position, and is moved to the lateral registration correcting position corresponding to the sheet of the A5 size illustrated in FIG. 6.

When the lateral registration correcting unit 1000 is returned to the letter position shown in FIG. 4, the stepping motor 200 is rotated clockwise and the cam 207 is rotated in the R direction. Thus, the cam surface 207*a* presses the pressure contact portion 208 against the spring 209. In association with it, the lateral registration correcting unit 1000 is moved in the direction of an arrow D1 shown in FIG. 6 and is moved again to the lateral registration correcting position corresponding to the sheet of the letter size.

In the embodiment, the movement of the lateral registration correcting unit 1000 is automatically executed based on a sheet size detection result obtained by detecting the sheet size by a sheet size detecting unit S provided for the LBP 50.

FIG. 8 is a control block diagram for controlling the duplex unit 10. A signal showing a size of sheets enclosed in the sheet feeding cassette 3*a* is input from the sheet size detecting unit S to the control unit C of the LBP 50. Based on the sheet size signal detected by the sheet size detecting unit S, the control unit C controls the rotating direction and the rotation amount of the stepping motor 200 of the duplex unit 10.

The sheet size can be also detected according to the position of a rear edge restricting member (not shown) for restricting a rear edge of the sheet in the sheet feeding cassette 3*a* and the position of a side edge restricting unit (not shown) for restricting a sheet side edge. The sheet size may be detected by the sheet size detecting unit (not shown) for detecting the size of sheets enclosed in the sheet feeding cassette 3*a*.

Further, it is also possible to construct the apparatus in such a manner that a plurality of sheet width detection flags (not shown) are arranged on the conveying surface on the downstream side of the conveying roller pair 3*e* (refer to FIG. 1), when the sheet is conveyed, a length in the width direction of the sheet is detected by the sheet width detection flags. Besides those detecting devices, it is also possible to construct the apparatus in such a manner that a plurality of jam sensor flags or the like are arranged in the conveying path of the LBP 50, the sheet length is detected by ON/OFF timing of the jam sensor flags or the like, and a size of regular sheet is detected based on the sheet length.

The operation of the LBP 50 will now be described.

When the image information is input to the control unit C, the control unit C discriminates whether or not the images are formed onto both sides of the sheet. If it is determined that the images are formed onto both sides, the stepping motor 200 of the duplex unit 10 is driven. First, the size signal is input from the sheet size detecting unit S. The stepping motor 200 is rotated clockwise in FIG. 7 according to the sheet size, thereby rotating the cam 207 in the direction of the arrow R shown in FIG. 4 by the rotation amount according to the sheet size. Thus, the lateral registration correcting unit 1000 is moved to the lateral registration correcting position of the sheet.

After that, the sheet is fed out of the sheet feeding cassette 3*a*, the image is formed onto the first side by the image forming unit 51, and the sheet is reversed by the discharge roller 3*h* and conveyed to the duplex unit 10. In the duplex unit, by rotating the stepping motor 200 clockwise in FIG. 7, the oblique feeding roller 101*a* is rotated, and the sheet is abutted to the reference surface 102 of the lateral registration correcting unit 1000 which has already been moved to the proper lateral registration correcting position, thereby correcting the lateral registration of the sheet. The sheet corrected to the normal position is sent to the image forming unit 51 again and the image is formed at the normal position.

By executing the movement of the lateral registration correcting unit 1000 by the cam 207 as described in the embodiment instead of using the rack and pinion gear which causes a looseness due to the backlash, the positional precision of the lateral registration correcting unit 1000 can be improved.

As already mentioned above, the movement of the lateral registration correcting unit 1000 to the lateral registration correcting position according to the sheet size is automatically executed based on the sheet size detection information by the various sheet size detecting units before the sheet reaches the lateral registration correcting unit 1000.

Further, since the lateral registration correcting unit 1000 can be moved merely by rotating the cam 207 in one direction, the rotation of the stepping motor 200 can be also used for the movement of the lateral registration correcting unit 1000 by switching the driving gear train through the pendulum unit 230.

That is, since the cam 207 can be rotated by the stepping motor 200 for driving the oblique feeding roller pairs 101A as another portion to be driven, the costs can be reduced and a size of duplex unit 10 can be miniaturized.

As mentioned above, by moving the reference guide 100 by the cam 207 according to the length of width direction of the sheet and rotating the cam 207 by the stepping motor 200, the lateral registration correction of the sheet can be certainly made without using any dedicated motor.

Although the embodiment has been described with respect to the case where the lateral registration correcting unit 1000 is moved according to the sheets of the sizes in a range from the A5 size to the letter size, the invention is not limited to such a case. For example, also in the case of the sheet of a size which is equal to or less than the A5 size or is equal to or larger than the letter size, by making the cam surface of the cam 207 correspond to the relevant sheet, the lateral registration correction of such a sheet can be easily made.

Although the stepping motor 200 for driving the oblique feeding roller pairs 101A has been used as a motor for driving the cam 207 in the above description, the invention is not limited to such a case. For example, even in the case of using a motor for driving a driven portion other than the oblique feeding roller pairs 101A, by using the switching unit 1002 having the foregoing structure, the apparatus can be easily constructed. In the switching unit 1002 of the embodiment, although the switching of the driving gear train from the motor has been performed by the pendulum unit, the switching unit can be also constructed by using a one-way clutch or the like.

Although the reference surface 102 of the lateral registration correcting unit 1000 has been moved by using the rotating cam in the embodiment, it is also possible to construct the apparatus in such a manner that a plurality of cam surfaces are provided in the slide direction for the cam which is slide-moved and the lateral registration correcting unit is moved according to the cam surfaces in the direction which crosses the sheet conveying direction.

Although the example in which the duplex unit 10 can be attached as an option has been described in the embodiment, the invention can be also applied to an apparatus in which the duplex unit has been provided integratedly with the image forming apparatus.

Although the example in which the sheet conveying apparatus of the invention has been applied to the duplex unit has been shown in the embodiment, the invention is not limited to such an example. The invention can be also applied to a registration apparatus (apparatus for correcting the oblique motion of the sheet and the position in the width direction of the sheet) provided on the upstream of the image forming unit. By this registration apparatus, the oblique motion of the sheet which is fed from the sheet feeding unit such as a sheet feeding cassette or the like is corrected and the position in the width direction is adjusted, so that the positioning of the sheet and the image is properly performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-266431, filed Sep. 29, 2006, which is hereby incorporated by reference herein in its entirety.

What is claimed is:

1. A sheet conveying apparatus for conveying a sheet, comprising:

a reference guide which is provided on a conveying path of the sheet along a sheet conveying direction;

an oblique feeding unit which can obliquely convey the sheet and which abuts a side edge of the sheet to the reference guide;

a cam which moves the reference guide in a direction which crosses the sheet conveying direction; and a motor which moves the cam and which drives the oblique feeding unit for conveying the sheet, wherein the reference guide is moved in the direction which crosses the sheet conveying direction by a cam surface of the cam which is moved by the motor, wherein the motor selectively performs the movement of the cam and the driving of the oblique feeding unit according to a forward/reverse rotation of the motor.

2. An apparatus according to claim 1, wherein a pressure contact portion which is come into pressure contact with the cam surface is provided for the reference guide and the apparatus has an urging member which urges the reference guide toward the cam so that the pressure contact portion is come into pressure contact with the cam surface.

3. An apparatus according to claim 1, wherein the motor drives an oblique feeding roller of the oblique feeding unit.

4. An apparatus according to claim 3, further comprising a switching unit which selectively transfers the rotation of the motor to the oblique feeding roller or the cam according to the forward/reverse rotation of the motor.

5. An apparatus according to claim 1, wherein the movement of the reference guide is performed by only one rotational direction of the cam.

6. An apparatus according to claim 5, wherein the cam has a plurality of cam surfaces along the rotating direction in order to restrict a position of the reference guide in a direction which perpendicularly crosses the sheet conveying direction according to a length in a width direction of the sheet.

7. An apparatus according to claim 1, further comprising a detecting unit which detects a length in a width direction of the sheet, and wherein the reference guide is moved in the direction which crosses the sheet conveying direction by the cam based on detection information from the detecting unit.

8. An apparatus according to claim 1, wherein the conveying path is provided to guide the sheet in which an image has been formed on one side by an image forming unit to the image forming unit again.

9. An image forming apparatus having a sheet conveying apparatus which conveys a sheet to an image forming unit, comprising:

a reference guide which is provided on a conveying path of the sheet along a sheet conveying direction;

an oblique feeding unit which can obliquely convey the sheet and which abuts a side edge of the sheet to the reference guide;

a cam which moves the reference guide in a direction which crosses the sheet conveying direction; and a motor which moves the cam and which drives the oblique feeding unit for conveying the sheet, wherein the reference guide is moved in the direction which crosses the sheet conveying direction by a cam surface of the cam which is moved by the motor, wherein the motor selectively performs the movement of the cam and the driving of the oblique feeding unit according to a forward/reverse rotation of the motor.

10. An apparatus according to claim 9, wherein the sheet conveying apparatus is provided to guide the sheet in which an image has been formed on one side by the image forming unit to the image forming unit again.

11. An apparatus according to claim 9, wherein a pressure contact portion which is come into pressure contact with the cam surface is provided for the reference guide and the apparatus has an urging member which urges the reference guide toward the cam so that the pressure contact portion is come into pressure contact with the cam surface.

12. An apparatus according to claim 9, wherein the motor drives an oblique feeding roller of the oblique feeding unit.

* * * * *